US007063010B2

(12) United States Patent
Zhang

(10) Patent No.: US 7,063,010 B2
(45) Date of Patent: Jun. 20, 2006

(54) PLATEN DESIGN FOR A C-FRAME PRESS

(75) Inventor: Ouqi Zhang, Downingtown, PA (US)

(73) Assignee: Dana Corporation, Toledo, OH (US)

( * ) Notice: Subject to any disclaimer, the term of this patent is extended or adjusted under 35 U.S.C. 154(b) by 4 days.

(21) Appl. No.: 10/684,372

(22) Filed: Oct. 15, 2003

(65) Prior Publication Data

US 2005/0092056 A1 May 5, 2005

(51) Int. Cl.
*B30B 15/04* (2006.01)
*B21J 13/04* (2006.01)

(52) U.S. Cl. ..... 100/231; 100/214; 100/269.17; 72/455

(58) Field of Classification Search ..... 100/214, 100/231, 269.17; 72/455; 83/859; 29/251, 29/257

See application file for complete search history.

(56) References Cited

U.S. PATENT DOCUMENTS

| | | | | |
|---|---|---|---|---|
| 2,869,177 | A | 1/1959 | Jurgeleit | |
| 3,030,879 | A * | 4/1962 | Lasko | 100/219 |
| 3,247,783 | A * | 4/1966 | Hammon | 100/214 |
| 3,765,322 | A | 10/1973 | Weyer | |
| 3,783,774 | A * | 1/1974 | Groos et al. | 100/214 |
| 4,064,734 | A * | 12/1977 | Pahnke | 72/455 |
| 4,240,342 | A | 12/1980 | Delmer | |
| 4,307,599 | A * | 12/1981 | Wrona | 72/446 |
| 4,309,893 | A * | 1/1982 | Mueller | 72/455 |
| 4,434,646 | A * | 3/1984 | Maeda et al. | 72/451 |
| 4,457,684 | A * | 7/1984 | Gram | 425/451.9 |
| 4,694,744 | A | 9/1987 | Hepburn et al. | |
| 5,379,689 | A * | 1/1995 | Timmons et al. | 100/43 |
| 5,482,454 | A * | 1/1996 | Miyahara et al. | 425/547 |
| 5,633,024 | A | 5/1997 | Ziv-Av | |
| 5,811,141 | A | 9/1998 | Pickel et al. | |
| 5,906,155 | A | 5/1999 | Hammond | |
| 6,536,251 | B1 * | 3/2003 | Marando et al. | 72/61 |
| 2002/0083749 | A1 | 7/2002 | Marando et al. | |

* cited by examiner

*Primary Examiner*—Derris H. Banks
*Assistant Examiner*—Jimmy T. Nguyen
(74) *Attorney, Agent, or Firm*—Berenato, White & Stavish LLC

(57) ABSTRACT

A platen design is provided for a C-frame press whereby an un-stiffened platen column connected in series to the tie rod; therefore, the stiffness of the tie rod is reduced. The unique design improves the fatigue strength of the tie rod by moving the reinforcing webs away from the column and directly onto the platen main body portion.

15 Claims, 4 Drawing Sheets

Fig. 6
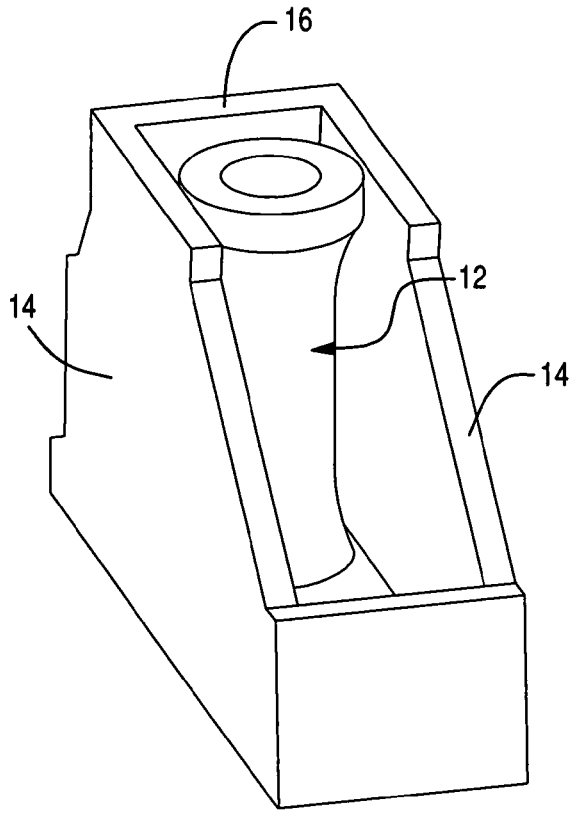
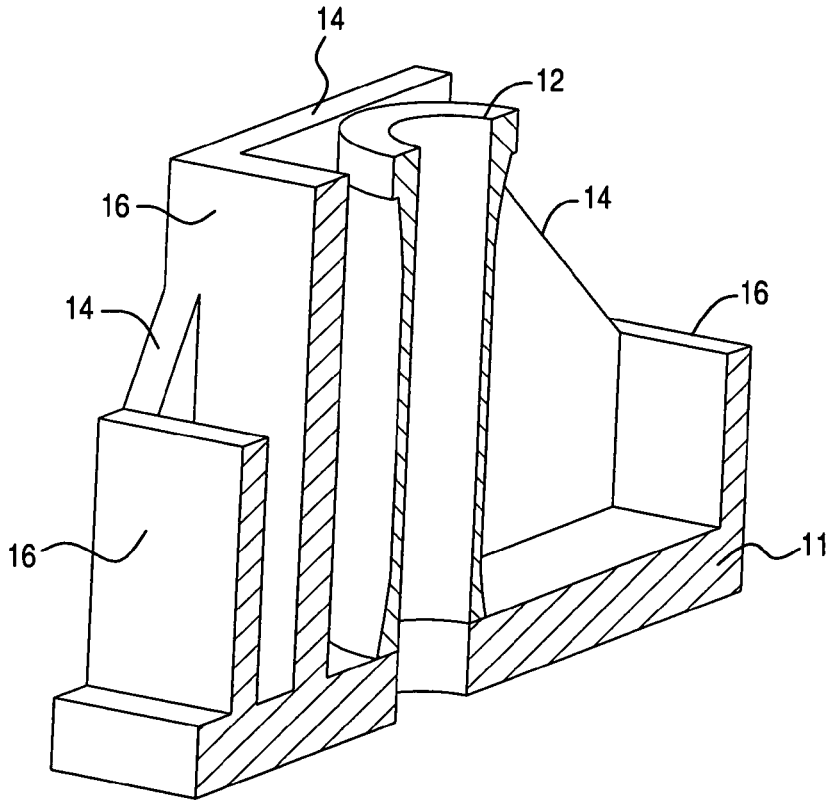
Fig. 7

PLATEN DESIGN FOR A C-FRAME PRESS

BACKGROUND OF THE INVENTION

1. Field of the Invention

The present invention relates to C-frame press structure, and particularly, to platen designs for a C-frame press.

2. Desciption of Related Art

As shown in FIGS. 1 and 2, the typical structure of a C-frame press mainly consists of two platens 1 and 2, each including a platen column 1*a* and 2*a*; a tie-rod 3 having a nut 3*a*, 3*b* threaded at one or both ends; a compression column 4 and a back column 5. All parts are tightened together by the tie rod 3 and nuts 3*a*, 3*b* with a pre-load. In operation, an additional tension load is added to the tie-rod 3. The platen 1 of FIG. 1 includes a platen column 1*a* as well as a platen web 1*b* and a lateral stiffener 1*c*.

In the illustrated conventional design, the fatigue strength of the tie-rod 3 that is subject to the alternating load often controls the press design.

It is known that the higher the compression column stiffness and/or the lower the tie-rod stiffness, the better the fatigue strength of the tie-rod.

As shown in FIGS. 3 and 4, the conventional platen design includes a platen column that is stiffened by the platen web 1*b* and a lateral stiffener 1*c*. The platen 1 has a base portion 1*d* for engaging a workpiece (not shown) along the lower planar surface. With the design of FIGS. 1–4, the platen column 1*a*, 2*a* is partially in series-connection with the compression column 4 and, consequently, the equivalent stiffness of the compression column 4 is reduced. In other words, the platen-column stiffness is detrimental to the tie rod 3 in the conventional design. Thus, the conventional thinking leads one of skill in the art to believe that it is undesirable to have low platen-column stiffness, and one of skill in the art would provide increased platen-column thickness.

Thus, the typical structure of a C-frame press mainly consists of two platens, a tie rod threaded at one or both ends, a compression column and a back column. All of the parts are tightened together by the tie rod with a pre-load. The conventional platen design includes a platen column that is stiffened by platen webs and lateral stiffener webs. The platen column is partially connected in series to the compression column, and consequently, the equivalent stiffness of the compression column is reduced. With this design, the platen column stiffness is always detrimental to the tie rod.

The need exists for an improved C-frame press having a platen assembly that improves the fatigue strength of the tie rod.

SUMMARY OF THE INVENTION

The present invention provides a platen design where the reinforcing web members are disconnected from the platen column. The reinforcing web members are moved to the platen base portion and away from the platen column.

An improved platen design is provided for a C-frame press whereby an un-stiffened platen column connected in series to the tie rod; therefore, the stiffness of the tie rod is reduced. The unique design improves the fatigue strength of the tie rod by moving the reinforcing webs away from the column and directly onto the platen.

BRIEF DESCRIPTION OF THE DRAWINGS

FIG. 6 is a perspective view of the platen design of this invention.

FIG. 7 is a cross sectional view of the platen design of this invention as shown in FIG. 6.

DETAILED DESCRIPTION OF PREFERRED EMBODIMENTS

Figure 2:
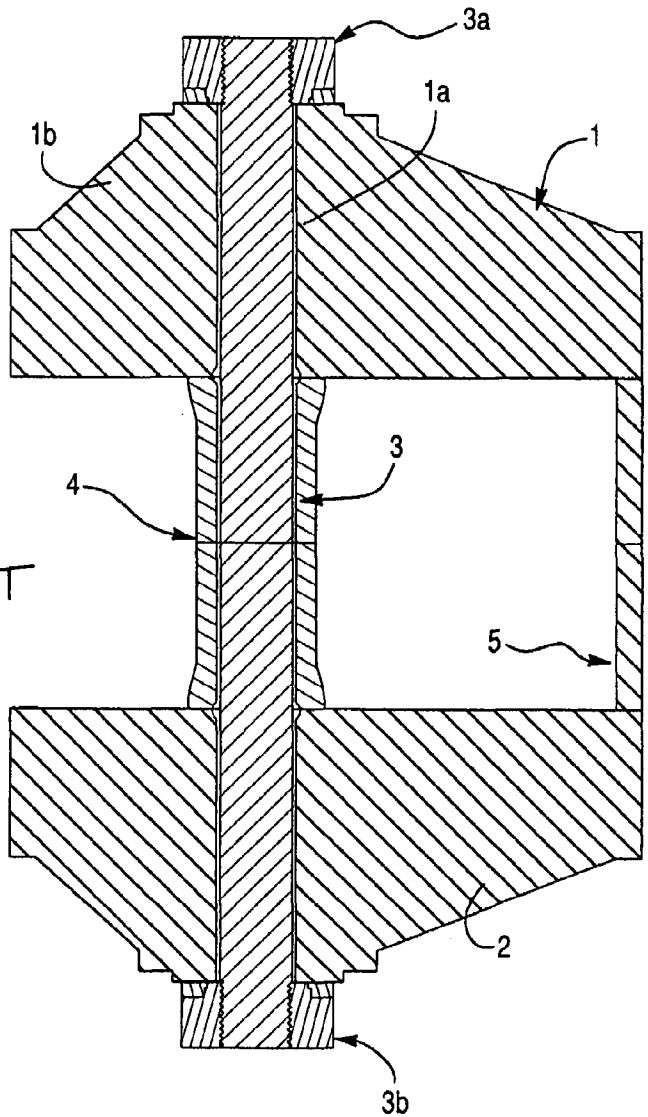
Fig. 2 PRIOR ART
FIG. 2 is a cross sectional view of the C-frame press structure of FIG. 1.
Figure 1:
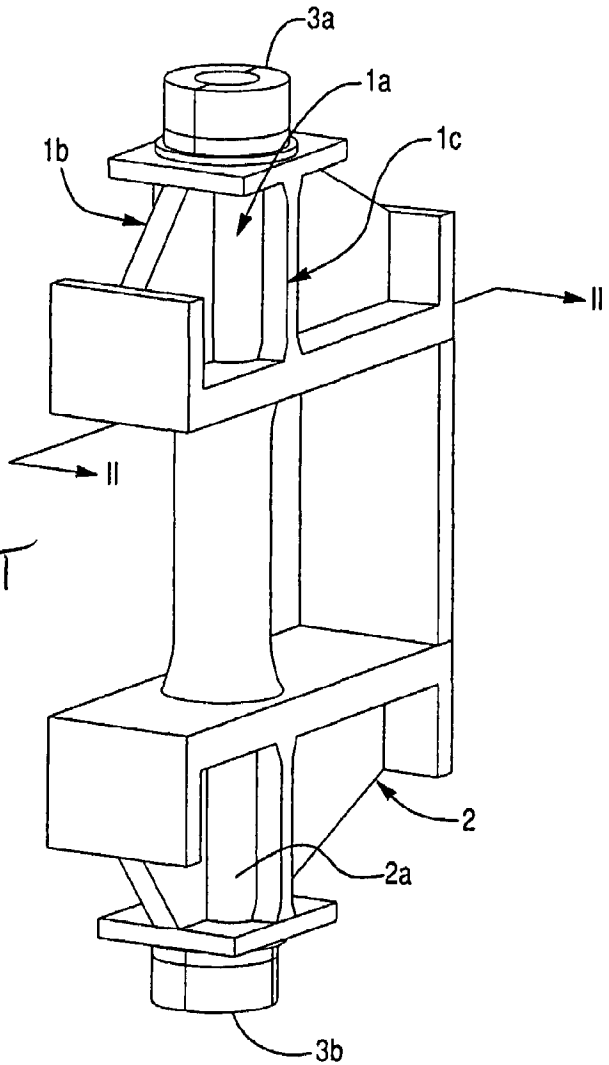
Fig. 1 PRIOR ART
FIG. 1 is a perspective view of a conventional structure of a C-frame press.
Figure 3:
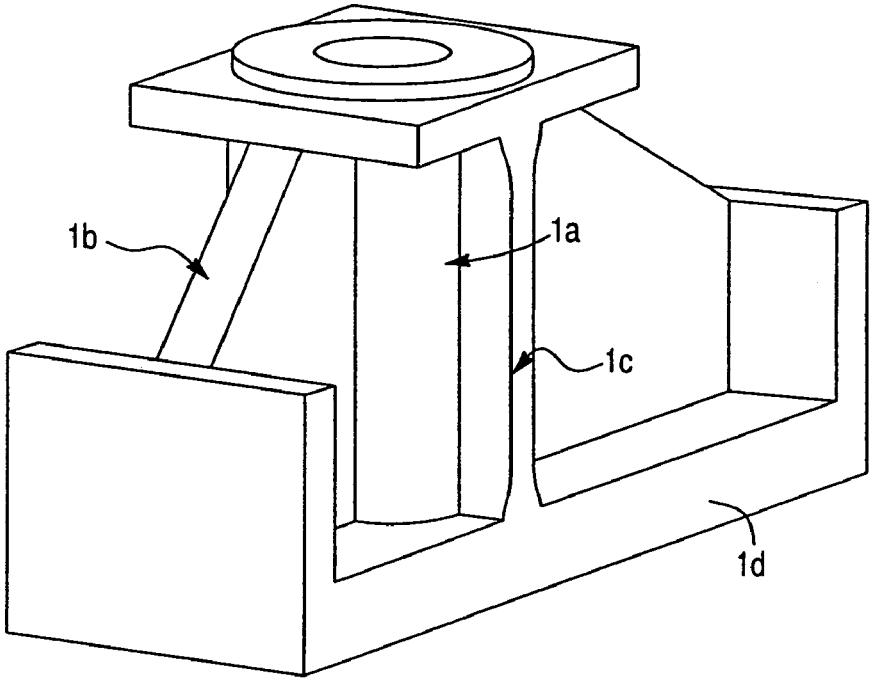
Fig. 3 PRIOR ART
FIG. 3 is a perspective view of a conventional platen structure of a C-frame press.
Figure 4:
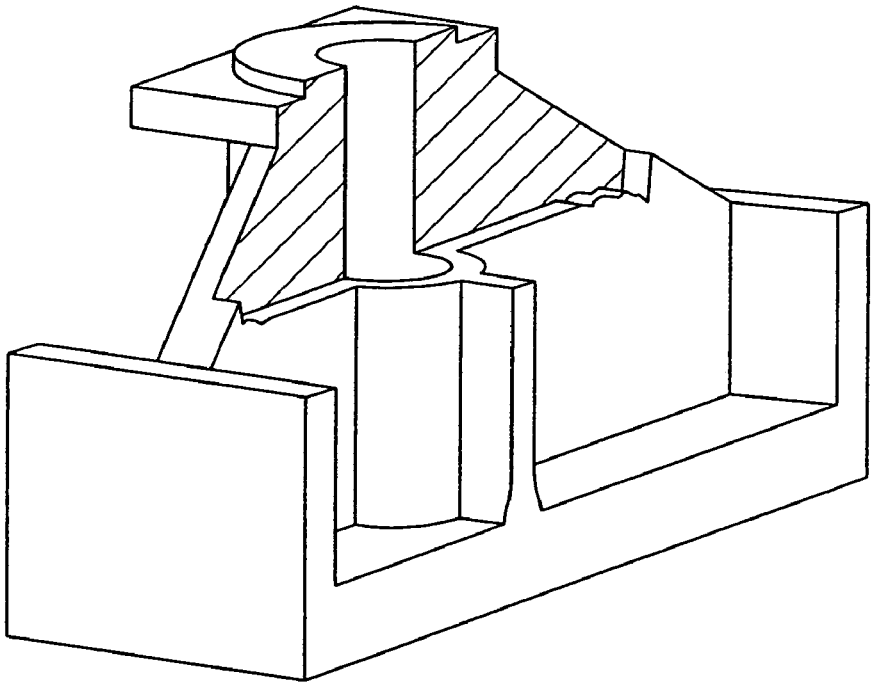
Fig. 4 PRIOR ART
FIG. 4 is a partial cross sectional view of the platen of FIG. 3.
Figure 5:
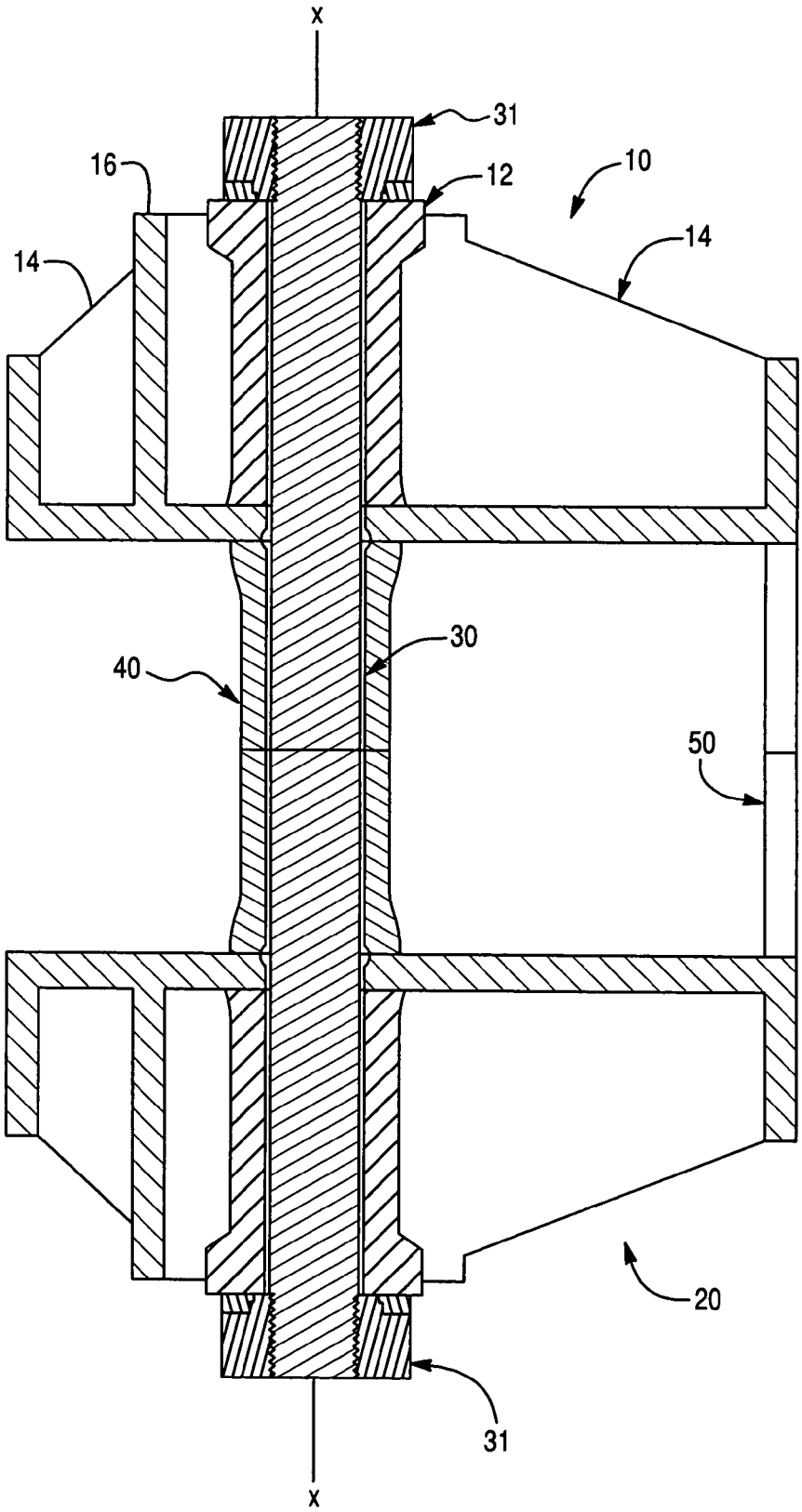
FIG. 5 is a perspective view of a C-frame press incorporating the platen member of the present invention.

With reference to FIG. 5, the unique structure of a C-frame press mainly having at least one platen member 10 including a platen column 12; a tie-rod 30 with nuts 31 threaded at one or both ends; a compression column 40 and a back column 50. All parts are tightened together by the tie rod 30 with a pre-load. In operation, an additional tension load is added to the tie-rod 30.

The platen 10 comprises a main body portion 11 including reinforcing platen webs 14 and lateral stiffeners 16. The platen column 12 is either separately disposed on or integrally fixed to the platen main body portion 11. In other words, since the platen column 12 is separated from the reinforcing webs 14 and the lateral stiffeners 16, the platen column 12 may also be separately formed with respect to the main body portion 11. The components defining the platen 10 are preferably formed by casting but they may be formed by any suitable method in accordance with the specifications for use of the platen and C-frame press; e.g., welding.

As shown in FIG. 5, the platen column 12 is longitudinally aligned with the compression column 40 along the press axis x—x defined by the tie rod 30. Operation of the C-frame press is accomplished in any conventional manner known by those of skill in the art. A workpiece (not shown) is inserted between the platens 10, 20 from the left side as viewed in FIG. 5 into the open end defined between the platen main body portions of the platen 10 and platen 20. In operation, the workpiece (not shown) may add tension to the tie rod and relieve stress from the compression column 40.

As shown in FIGS. 5–7, the platen member 10 has a unique configuration that improves fatigue strength of the tie rod 30. The unique design improves the fatigue strength of the tie rod 30 by moving the reinforcing webs 14 and lateral stiffeners 16 away from the platen column 12 and directly onto the platen main body portion 11.

From the foregoing description, it is clear that the present invention provides a platen design where the reinforcing web members 14, 16 are disconnected from the platen column 12. The reinforcing web members 14, 16 are moved to the platen main body portion 11 and away from the platen column 12.

Thus, an improved platen design is provided for a C-frame press whereby an un-stiffened platen column connected in series to the tie rod; therefore, the stiffness of the tie rod is reduced. The unique design improves the fatigue strength of the tie rod by moving the reinforcing webs away from the column and directly onto the platen.

While the foregoing invention has been shown and described with reference to preferred embodiments, it will be understood that various changes in form and detail may be made therein without departing from the spirit and scope of the present invention.

The invention claimed is:

1. A platen member for use in a C-frame press assembly, said platen member comprising:

a platen column having a central aperture and defining a column axial length, said platen column defining a press axis;

a tie rod is adapted to pass through the aperture of the platen column;

a platen body having a base portion and at least one web portion, the platen column is positioned on the base portion, wherein said at least one web portion is positioned around the column axial length and is not rigidly connected with said platen column along the column axial length, and wherein said at least one web portion is connected to said platen column only through said base portion to thereby reduce a platen column stiffness.

2. The platen member according to claim 1, wherein said at least one web portion comprises at least one lateral stiffener and at least one transverse web member disposed transverse to said at least one lateral stiffener, said lateral stiffener and said transverse web member being spaced from said platen column.

3. The platen member according to claim 1, wherein said platen column is longitudinally aligned with a compression column abuting said base portion.

4. The platen member according to claim 3, wherein said platen column is disposed to receive said compression force from a nut member threadingly engaging a tie rod, said web portion being isolated from said compression force.

5. The platen member according to claim 1, wherein said web portion comprises a pair of parallel walls extending parallel to said press axis.

6. The platen member according to claim 1, wherein said web portion comprises at least four walls extending above said base portion along a direction parallel to said press axis.

7. The platen member according to claim 1, wherein said platen column is integrally formed with said base portion.

8. The platen member according to claim 1, wherein said platen column is separately formed with respect to said base portion.

9. The platen member according to claim 1, wherein said platen column is not connected directly with said web portion.

10. A platen assembly for a C-frame press comprising:

a hollow platen column through which a tie rod is adapted to pass;

a platen main body including a base press portion and a plurality of platen webs integral with said base press portion, the platen column is positioned on the base press portion around said platen column, said platen webs being remote from said platen column and said platen webs are positioned around said platen column such that said platen webs do not connect directly with said platen column, wherein said platen column is adapted to be connected in series with said tie rod to thereby reduce a platen column stiffness, and wherein said platen webs are connected to said platen column only through said base press portion.

11. The platen assembly according to claim 10, wherein said platen webs comprises at least one lateral stiffener and at least one transverse web member disposed transverse to said at least one lateral stiffener, said lateral stiffener and said transverse web member being spaced from said platen column.

12. The platen assembly according to claim 10, wherein said platen column is longitudinally aligned with a compression column abuting said platen main body.

13. The platen assembly according to claim 12, wherein said platen column is disposed to receive a compression force from a nut member threadingly engaging said tie rod, said platen web being isolated from said compression force.

14. The platen member according to claim 1, wherein a lower end of said at least one web portion and a lower end of said platen column are supported by said base portion.

15. The platen member according to claim 10, wherein a lower end of said platen webs and a lower end of said platen column are supported by said base press portion.

* * * * *